United States Patent [19]

Dizon et al.

[11] Patent Number: 4,815,237

[45] Date of Patent: Mar. 28, 1989

[54] SEALING ARRANGEMENT FOR ENCLOSURE HAVING AN ACCESS DOOR

[75] Inventors: Edmund S. Dizon, Chicago; Arvydas J. Kalvaitis, Northbrook, both of Ill.

[73] Assignee: S&C Electric Company, Chicago, Ill.

[21] Appl. No.: 117,892

[22] Filed: Oct. 30, 1987

Related U.S. Application Data

[63] Continuation of Ser. No. 922,377, Oct. 23, 1986, abandoned.

[51] Int. Cl.[4] ..... E06B 7/16

[52] U.S. Cl. ..... 49/383; 49/485; 49/495

[58] Field of Search ..... 49/383, 485, 495, 402

[56] References Cited

U.S. PATENT DOCUMENTS

| | | | |
|---|---|---|---|
| 2,671,935 | 3/1954 | Flues | 49/495 X |
| 3,308,582 | 3/1967 | Bakke | 49/383 |

FOREIGN PATENT DOCUMENTS

| | | | |
|---|---|---|---|
| 356267 | 9/1961 | Switzerland | 49/383 |
| 1411397 | 10/1975 | United Kingdom | 49/402 |

*Primary Examiner*—Philip C. Kannan

*Attorney, Agent, or Firm*—James V. Lapacek

[57] ABSTRACT

A sealing arrangement is provided that includes a resilient seal member that is disposed generally parallel to the pivot axis of an access door of an enclosure. The seal member includes a first leg proximate the hinge axis and extending away from the enclosure. When the door is pivoted from an open position toward the closed position, the first leg is displaced toward the enclosure. As the door is further moved toward the closed position, the first leg is additionally displaced, deformed and compressed to provide sealing of the door with respect to the enclosure. The proximity of the seal member to the hinge axis and the arrangement of the first extending leg is such that relative wiping action occurs between the door and the first extending leg. In a preferred arrangement, the seal member also includes a second leg extending from the enclosure. The second leg is termed an inner leg since it is adjacent or proximal the access opening and the first leg is termed an outer leg since it is distal of the access opening and proximate the hinge axis. Wiping action also occurs between the second leg and the door as the door is closed. During door closure, the second leg is displaced and deformed toward the enclosure. With the door in the fully closed position, the second leg is also deformed and compressed to provide a seal against the door.

11 Claims, 3 Drawing Sheets

SEALING ARRANGEMENT FOR ENCLOSURE HAVING AN ACCESS DOOR

This is a continuation of application Ser. No. 922,377, filed Oct. 23, 1986, abandoned.

BACKGROUND OF THE INVENTION

1. Field of the Invention

The present invention relates generally to a sealing arrangement for an enclosure having an access door and more particularly to a sealing arrangement that provides an improved seal, permits a more efficient enclosure configuration, and that allows the use of a seal member of a more flexible material.

2. Description of the Related Art

Various sealing arrangements and gaskets are known for the doors and windows of houses, vehicles, and the like. For example, sealing arrangements including gaskets of various types are found in the following publications: German Patent Document No. 581,038, U.S. Pat. Nos. 2,591,833, 1,706,597, 2,647,792, 2,593,305, 2,671,935, 1,991,674, and 1,763,603, and Czechoslovakian Pat. No. 69,908. However, these arrangements primarily relate to configurations that result in deformation and compression of the seal member and are not especially useful for providing a desirable seal at the pivot axis of an enclosure door.

For illustration of a sealing arrangement for an enclosure utilized in metal-enclosed high-voltage switchgear manufactured by the present assignee, reference is made to FIG. 6 of this application which is labeled "Prior Art". In that prior art arrangement, the seal member 100 is deformed and compressed as the door 110 is pivoted to a closed position as shown in FIG. 6. Additionally, the seal member 100 must be positioned with respect to the hinge axis 120 and be fabricated of sufficiently rigid material to withstand the side-bending or twisting force in the direction 130 that is applied to the seal member 100 as the door 110 is closed. If it is desired to utilize the latching mechanism of U.S. Pat. No. 4,489,966 which automatically latches upon door closure, the seal member 100 must be implemented with a more flexible material to permit actuation of the latching mechanism. However, as stated hereinbefore, this is inconsistent with the seal member 100 being rigid enough to withstand the various forces on closing.

While the aforementioned arrangements may be generally suitable for sealing arrangements of various articles and structure, it is desirable to provide a sealing arrangement utilizing a seal member of flexible material in a predetermined configuration and being disposed in close proximity to the pivot axis of an access door of an enclosure to permit efficient design of the access door and enclosure while providing a reduction of undesirable forces being applied to the seal member.

SUMMARY OF THE INVENTION

Accordingly, it is a principal object of the present invention to provide an improved sealing arrangement for an access door of an enclosure which provides desirable sealing characteristics, permits the use of a more flexible material for the seal member, and reduces undesirable distortion of the seal member.

It is another object of the present invention to provide a sealing arrangement that is capable of being positioned in close proximity to a pivot axis of an access door of an enclosure so as to permit a more efficient configuration of the enclosure and the access door.

These and other objects of the present invention are efficiently achieved by a sealing arrangement that includes a resilient seal member that is disposed generally parallel to the pivot axis of an access door of an enclosure. The seal member includes a first leg proximate the hinge axis and extending away from the enclosure. When the door is pivoted from an open position toward the closed position, the first leg is displaced toward the enclosure. As the door is further moved toward the closed position, the first leg is additionally displaced, deformed and compressed to provide sealing of the door with respect to the enclosure. The proximity of the seal member to the hinge axis and the arrangement of the first extending leg is such that relative wiping action occurs between the door and the first extending leg. In a preferred arrangement, the seal member also includes a second leg extending from the enclosure. The second leg is termed an inner leg since it is adjacent or proximal the access opening and the first leg is termed an outer leg since it is distal of the access opening and proximate the hinge axis. Wiping action also occurs between the second leg and the door as the door is closed. During door closure, the second leg is dispaced and deformed toward the enclosure. With the door in the fully closed position, the second leg is also deformed and compressed to provide a seal against the door.

DETAILED DESCRIPTION

Figure 1:
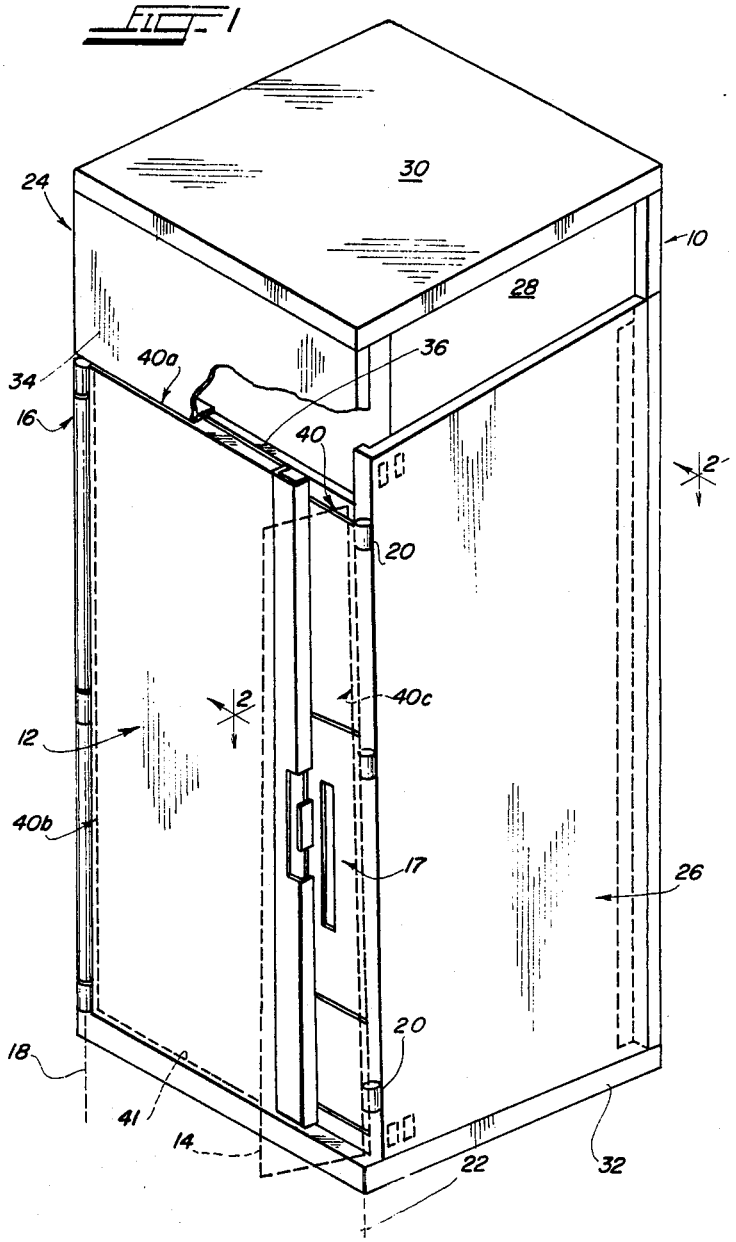
FIG. 1 is a perspective view of an enclosure having an access door and which utilizes the sealing arrangement of the present invention.
Figure 2:
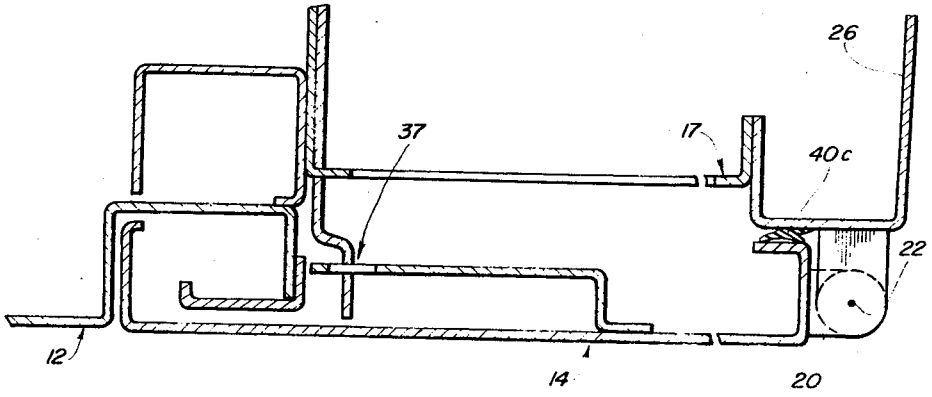
FIG. 2 is a view partly in section taken generally along the line 2—2 of FIG. 1.
Figure 6:
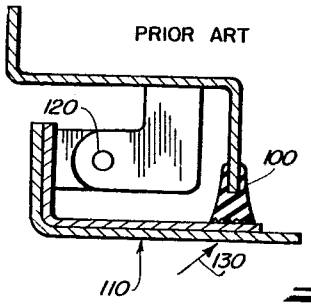
FIG. 6 is a view, partly in section, illustrating a sealing arrangement of the prior art.

Referring now to FIGS. 1 and 2, the sealing arrangement of the present invention is utilized to provide a seal to the enclosure 10 around the periphery of an access opening covered by left door 12 and a right door 14 (FIG. 2) that partially overlaps the left door 12. The left door 12 is pivotally mounted with respect to the enclosure 10 by a plurality of hinges 16 along a left pivot axis 18. The right door 14 is pivotally mounted with respect to the enclosure 10 by a plurality of hinges 20 along a right pivot axis 22. The enclosure 10 is generally defined by two vertical sidewalls 24 and 26, a vertical backwall 28, a roof 30, a base 32, and a front panel 34. In another specific arrangement, the front panel 34 is omitted and the doors 12 and 14 extend the full height of the enclosure 10 between the roof 30 and the base 32. Fabrication and structural details of the enclosure 10 are set forth in more detail in co-pending U.S. application Ser. No. 922,376 filed in the names of A.J. Kalvaitis, et al. on Oct. 23, 1986. The right door 14 may also be referred to as a cover since, in the illustrative arrangement, the enclosure 10 functions as metal-enclosed switchgear and the right door or cover 14 overlaps a compartment which houses a switch operator and associated controls behind a compartment panel 17. The access opening of the enclosure 10 is generally defined as the space between the sidewalls 24, 26, the base 32, the first panel 34, and the compartment cover 17. However, it should be understood that in other specific arrangements, a single left or right door is provided that covers the entire access opening.

Figure 3:
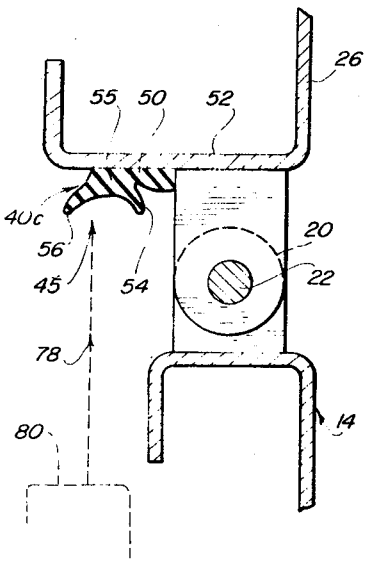

The sealing arrangement of the present invention includes a seal member generally referred to at 40 and including portions 40*a*, 40*b* and 40*c*. The vertical seal-member sections 40*b* and 40*c* are disposed adjacent to and along the pivot axes 18 and 22 respectively. The seal-member sections 40*b* and 40*c* are affixed to the front edges of the vertical sidewalls 24, 26 respectively. The seal-member portion 40*a* is disposed horizontally and affixed to an upper channel member 36. The upper channel member 36 spans the sidewalls 24, 26. Accordingly, the seal member 40, including section 40*a*, 40*b*, and 40*c*, provides a sealing surface 45 as shown in FIG. 3; seal-member portion 40*b* providing a sealing surface to the vertical edge of the left door 12 along left pivot axis 18, seal-member portion 40*c* providing a sealing surface to the vertical edge of the right door 14 along the right pivot axis 22, and seal-member portion 40*a* providing a sealing surface to the top horizontal edges of doors 12 and 14. In a preferred arrangement, the lower horizontal edge 41 near the base 32 that abuts the door 12 along the lower edge thereof is not provided with a portion of the seal member 40.

The seal member 40 includes a uniform cross section. As can best be seen in FIG. 3 by illustration of seal member portion 40c, the seal member 40 includes a generally flat, rear surface 50 that is affixed to the front edge 52 of the right sidewall 26 by adhesive or the like. The sealing member 40 also includes a first leg 54 and a second leg 56 that extend from a central body portion 55 of the seal member 40. The second leg 56 is disposed along the inner edge of the periphery of the access opening of the enclosure 10. The first leg 54 is termed an outer leg since the second leg 56 is adjacent or proximal the access opening and the first leg 54 is distal the access opening and adjacent the right pivot axis 22 (seal-member portion 40*c*). The seal member 40 is fabricated such that the first and second legs 54, 56 extend from the central portion 55 and present the concave sealing surface 45 to the right door 14 as the right door 14 is pivoted toward the closed position as shown by the transition from FIGS. 3 to 4. The seal member 40 is fabricated so as to be extremely flexible and resilient such that the first and second legs 54 and 56 are easily displaceable and/or deformable to their positions in FIG. 4 from their relative positions shown in FIG. 3. For example, in a preferred arrangement, the seal member 40 is fabricated from neoprene or other suitable elastomer.

As the right door 14 is pivoted toward the partially closed position (FIG. 4), the inner surface 60 of the right door 14 contacts the second leg 56 at 62 and the first leg 54 at 64. The point of contact at 62 between the inner surface 60 of the door at 60 and the second leg 56 moves as the second leg 56 slides or wipes against the door edge 60 which can be characterized as a wiping effect due to the relative movement between the point of contact 62 between the inner surface 60 of the right door 14 and the second leg 56. The first leg 54 is also moved or displaced from its position in FIG. 3 and also exhibits a wiping effect with respect to the inner surface 62 of the right door 14. However, the wiping effect with respect to the first leg 54 is less pronounced than that for the second leg 56. While the displacement of the second leg 56 is to the left in FIG. 4, the displacement of the first leg 54 is to the right in FIG. 4; the overall effect being to spread the legs 54, 56 apart from each other.

Figure 5:
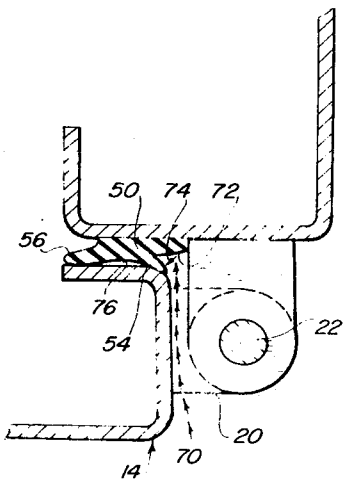
FIGS. 3–5 are enlarged views, partly in section, of portions of FIG. 2 and illustrating the sealing arrangement of the present invention at various stages of operation thereof in response to the position of the access door.
Figure 4:
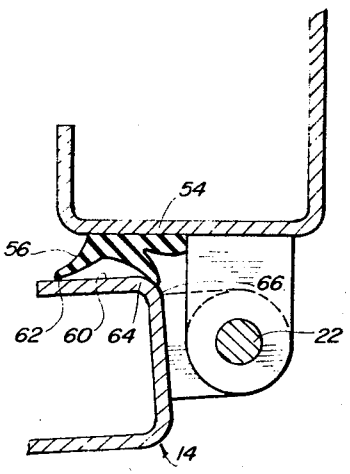

As the right door 14 is further moved from the partially closed position in FIG. 4 to the fully closed position of FIG. 5, further displacement of each of the legs 54 and 56 occurs as they are displaced and are rotated or pivoted toward the back surface 50. At the same time, the legs 54 and 56 and a portion of the central body 55 are deformed and/or compressed to provide a seal with respect to the inner surface 60 of the door 14. As can be seen in FIGS. 4 and 5, the function of the first leg 54 is enhanced by working against the smooth,.rounded corner 66 of the door 14. Additionally, the generally tangential approach of the inner surface 62 to the sealing surface 45 and substantially perpendicular approach to the first leg 54 along with the shape and disposition of the first leg 54, and the relative placement of the pivot axis 22, provides desirable wiping action and avoids any undesirable stresses in the seal member 40*c*. As illustrated by FIGS. 3–5, the location of the pivot axis 22 relative to the first leg 54 is such that the first leg extends from the front edge 52 of the right sidewall 26 in the general direction of the pivot axis 22. Any undesirable stresses, as exemplified by the prior art arrangements, causes tearing, permanent deformation and/or separation of the seal member with respect to the enclosure. As shown in FIG. 2, as the right door 14 is moved to the fully closed position of FIG. 5, a latch arrangement generally referred to at 37 is actuated to latch the door 14, as discussed more fully in U.S. Pat. No. 4,489,966.

As can be seen in FIG. 5, an effective seal is provided between the environment and the access opening of the enclosure 10 by the action of the seal member 40 against the inner surface 60 of the right door 14. For example, with the right door 14 in the closed position of FIG. 5, rain driven by wind entering along the path 70, between the door 14 and the hinge 20, encounters the seal member 40 at 72 and bounces off and impinges against the first leg 54 in a direction 74 to create an additional sealing force between the first leg 54 and the inner surface 60 of the right door 14; the greater the driving effect of the rain, the greater the sealing force. Accordingly, the first outer leg 54 is first encountered by the environment and is the first line of protection against the attempted ingress of the environment and moisture to the access opening of the enclosure 10. The second, inner leg 56 provides a second line of protection (or backup) to the seal provided at the first outer leg 54. With the door in the fully closed position, as shown in FIG. 5, the gap 76 defined between the legs 54, 56 also serves to funnel water down or provide a path for water at the bottom of the door 14 and out to the environment. The seal provided by the seal-member portion 40*b* along the axis 18 at the left door 12 is identical to that as shown in FIGS. 3–5; e.g. a mirror image thereof. For illustrative purposes and considering FIG. 3 to depict the seal-member portion 40*a* along the top horizontal edge of the enclosure 10, as the left door 12 is pivoted to the closed position as shown in FIG. 1, the edge 80 of the left door 12 will approach the seal-member portion 40*a* in the direction 78. Of course, this illustration is approximate since the left door 12 is pivoted with respect to the seal member 40*a*, and the edge 80 of the left door 12 will not simultaneously contact points along all portion of the seal-member portion 40*a*.

While there have been illustrated and described various embodiments of the present invention, it will be apparent that various changes and modifications will occur to those skilled in the art. For example, it should be realized that the present invention is practiced by the relative movement between the door 14 and the sidewall 26 about the pivot axis 22. Accordingly, in other specific embodiments, the sidewall 26 functions as the movable member and the door 14 functions as the stationary member. Of course, in other embodiments, both the door 14 and the sidewall 26 can be arranged to be movable with respect to the pivot axis 22. It is intended in the appended claims to cover all such changes and modifications as fall within the true spirit and scope of the present invention.

What is claimed and desired to be secured by Letters Patent of the United States is:

1. A sealing arrangement for an enclosure having an access opening and a pivotally mounted access door movable between open and closed positions, the sealing arrangement comprising:

a door;

means defining a pivot axis and being carried by the enclosure for pivotally supporting said door, said door having a first inner surface adjacent said pivot axis; and a resilient seal member being affixed to the enclosure and being disposed generally parallel to said pivot axis, said pivot axis being located distal of the enclosure relative to said resilient sealing member, said resilient seal member in cross section to said pivot axis including a first leg proximate said pivot axis and extending away from the enclosure and toward said pivot axis, said first inner surface of said door when pivoting from said open position toward said closed position approaches said first leg and displaces said first extending leg toward the enclosure, and as said door is further moved toward said closed position, said first leg is displaced, deformed and compressed to provide a seal with respect to said first inner surface of said door, the location of said seal member with respect to said pivot axis and the arrangement of said first leg being such that relative wiping action occurs between said first inner surface of said door and said first leg as said door is closed, said pivot axis being spaced from said first leg a first distance that is measured along the enclosure and parallel to said first inner surface when said first inner surface is in said closed position, said pivot axis also being a second distance from said resilient seal member, said first distance being significant compared to said second distance.

2. The sealing arrangement of claim 1 wherein said first inner surface of said door is defined by two substantially perpendicular planar surfaces defining a rounded corner, said initial point of contact between said door and said sealing member being proximate said rounded corner.

3. The sealing arrangement of claim 1 wherein said seal member is also disposed along one or more additional portions of the enclosure to provide a seal with respect to said door.

4. The sealing arrangement of claim 1 wherein said resilient seal member further includes a second leg proximate the access opening of the enclosure and extending away from the enclosure, said second leg being displaced and deformed toward said enclosure as said door is pivoted from said open position toward said closed position, as said door is further moved toward said closed position, said second leg being additionally deformed and compressed to provide a seal of said first inner surface with respect to said first inner surface of said door.

5. The sealing arrangement of claim 4 wherein said second leg is arranged such that relative wiping action occurs between said first inner surface of said door and said second leg.

6. The sealing arrangement of claim 4 wherein said sealing member via said first and second legs defines a concave surface that is presented to said first inner surface of said door.

7. The sealing arrangement of claim 4 wherein said seal member and said door define a gap when said door is in the closed position.

8. A sealing arrangement comprising:

first and second members means for providing relative movement between said first and second members between respective open and closed positions about a pivotal axis; and a resilient seal member being affixed to said first member and being disposed generally parallel to said pivot axis, said resilient sealing member in a plane perpendicular to said pivot axis including a first leg extending away from said first member and in the general direction of said pivot axis, said second member displacing said first leg toward said first member upon relative movement of said first and second members toward one another about said pivot axis, said pivot axis being spaced a first distance from said first leg as measured along said first member and parallel to said second member when said first and second members are in the closed position, said pivot axis also being a second distance from said resilient seal member, said first distance being significant compared to said second distance.

9. The sealing arrangement of claim 8 wherein said first leg of said seal member in said plane perpendicular to said pivot axis defines a curved surface which curves away from said first member and faces said second member.

10. The sealing arrangement of claim 8 wherein said seal member in said plane perpendicular to said pivot axis further comprises a second leg extending away from said first member in a direction substantially perpendicular to said first leg, said seal member including a concave surface defined by said two legs.

11. The sealing arrangement of claim 8 wherein said second member comprises two substantially perpendicular planar surfaces defining a rounded corner, said initial point of contact between said second member and said first leg being proximate said rounded corner.

* * * * *